US005810993A

United States Patent [19]

Keller et al.

[11] Patent Number: 5,810,993

[45] Date of Patent: Sep. 22, 1998

[54] ELECTROLYTIC PRODUCTION OF NEODYMIUM WITHOUT PERFLUORINATED CARBON COMPOUNDS ON THE OFFGASES

[75] Inventors: Rudolf Keller, Export; Kirk T. Larimer, Pittsburgh, both of Pa.

[73] Assignee: EMEC Consultants, Export, Pa.

[21] Appl. No.: 831,652

[22] Filed: Apr. 9, 1997

Related U.S. Application Data

[60] Provisional application No. 60/030,698 Nov. 13, 1996.

[51] Int. Cl.[6] ..... C25C 3/34

[52] U.S. Cl. ..... 205/368; 205/363; 205/365

[58] Field of Search ..... 205/368, 363, 205/365

[56] References Cited

U.S. PATENT DOCUMENTS

| | | | |
|---|---|---|---|
| 3,729,397 | 4/1973 | Goldsmith et al. | 205/363 |
| 3,855,087 | 12/1974 | Yamanaka et al. | 205/363 |
| 4,578,242 | 3/1986 | Sharma | 420/590 |
| 4,684,448 | 8/1987 | Itoh et al. | 204/71 |
| 4,737,248 | 4/1988 | Nakamura et al. | 204/71 |
| 4,747,924 | 5/1988 | Itoh et al. | 204/225 |
| 4,828,658 | 5/1989 | Bertaud | 204/71 |
| 4,966,661 | 10/1990 | Tamamura | 204/64 |
| 4,966,662 | 10/1990 | Tamamura | 204/71 |
| 5,091,065 | 2/1992 | Tamamura | 204/64 |
| 5,118,396 | 6/1992 | Claus et al. | 204/64 |
| 5,188,711 | 2/1993 | Feddrix | 204/71 |
| 5,258,103 | 11/1993 | Endoh et al. | 204/71 |

FOREIGN PATENT DOCUMENTS 4304394 10/1992 Japan .

OTHER PUBLICATIONS

Dysinger, D.K. et al, "Electrowinning of Neodymium From a Molten Oxide–Fluoride Electrolyte", U.S. Dept. of the Interior, Bureau of Mines, Report of Investigations/9504, 1994, no month available.

Morrice, E. et al, "Direct Electrolysis of Rare–Earth Oxides to Metals and Alloys in Flouride Melts", U.S. Dept. of the Interior, Bureau of Mines, Report of Investigations 7146, Jun. 1968.

Shedd, E.S. et al, Electrowinning and Tapping of Lanthanum Metal, U.S. Dept. of the Interior, Bureau of Mines, Report of Investigations 6882, 1966, no month available.

Morrice, E. et al, Electrowinning High–Purity Neodymium, Praseodymium, and Didymium Metals From Their Oxides, U.S. Dept. of the Interior, Bureau of Mines, Report of Investigations 6957, May 1967.

Morrice, E. et al, "Effect of Temperature on the Electrolytic Preparation and Recovery of Samarium–Cobalt Alloy", U.S. Dept. of the Interior, Bureau of Mines, Report of Investigations 7556, 1971, no month available.

Morrice, E. et al, Preparation of Cobalt–Rare–Earth Alloys by Electrolysis, *J. of Metals*, Jan. 1969, pp. 34–37.

Kaneko, A. et al, Electrochemistry of Rare Earth Fluoride Molten Salts, *J. of Alloys and Compounds*, 193(1993) 44–46, no month available.

Shimada, T. et al, Electrowinning Neodymium from Its Oxide in Molten Flouride Misture, Technology Reports of the Osaka Univ., vol. 42, No. 2084 (Apr., 1992)pp. 77–83.

*Primary Examiner*—Kathryn L. Gorgos
*Assistant Examiner*—Kishor Mayekar
*Attorney, Agent, or Firm*—Andrew Alexander

[57] ABSTRACT

A method of producing neodymium in an electrolytic cell without formation of perfluorinated carbon gases (PFCs), the method comprising the steps of providing an electrolyte in the electrolytic cell and providing an anode in an anode region of the electrolyte and providing a cathode in a cathode region of the electrolytic cell. Dissolving an oxygen-containing neodymium compound in the electrolyte in the anode region and maintaining a more intense electrolyte circulation in the anode region than in the cathode region. Passing an electrolytic current between said anode and said cathode and depositing neodymium metal at the cathode, preventing the formation of perfluorinated carbon gases by limiting anode over voltage.

26 Claims, 3 Drawing Sheets

ELECTROLYTIC PRODUCTION OF NEODYMIUM WITHOUT PERFLUORINATED CARBON COMPOUNDS ON THE OFFGASES

The Government has rights in this invention pursuant to Contract No. DE-FC07-91ID13104 awarded by the Department of Energy.

CROSS REFERENCE TO RELATED APPLICATION

This application claims the benefit of U.S. Provisional application Ser. No. 60/030,698, filed Nov. 13, 1996.

BACKGROUND OF THE INVENTION

This invention relates to neodymium and more particularly, it relates to an improved process for producing neodymium and neodymium alloys in an electrolytic cell.

In the electrolysis of neodymium oxide from a molten fluoride electrolyte, anode effects can occur at the anode, interfering with operation of the cell. They manifest themselves by an increase in cell voltage, and, if a power supply with voltage limitations is used, also by a decrease in cell current. Occurrences of anode effects prevent smooth cell operation; also, non-metallic or sludge-like deposits on cathodes and in other parts of the cell prevent smooth cell operations. Another problem that can occur is the production or off gassing of fluorine-containing (perfluorinated carbon) compounds such as $CF_4$ or $C_2F_6$. The uncontrolled emissions of such fluorine-containing compounds cause serious environmental implications because they are potent and very-long-living greenhouse gases contributing to global warming. For example, it is believed that conventional electrolytic production of neodymium can contaminate the atmosphere with perfluorinated carbon as much as the entire aluminum industry if the offgases are not treated.

Thus, it will be seen that it is highly desirable to operate the cell without anode effects, without the production of fluorine-containing compounds, and without excessive side reactions in the cathode region.

Different methods have been proposed for the production of neodymium. For example, U.S. Pat. No. 4,578,242 discloses that rare earth oxides can be reduced to rare earth metals by a novel, high yield, metallothermic process. The oxides are dispersed in a suitable, molten, calcium chloride bath along with sodium metal. The sodium reacts with the calcium chloride to produce calcium metal which reduces the rare earth oxides to rare earth metals. The metals are collected in a discrete layer in the reaction vessel.

U.S. Pat. No. 5,188,711 discloses a process for making alloys of rare earth metal and other metals comprising contacting a lanthanum salt with nickel under conditions sufficient to form a liquid mixture, placing an anode and a cathode in contact with the mixture and placing an electrical potential between the anode and cathode so that an alloy of lanthanum and nickel forms at one of the electrodes.

U.S. Pat. No. 5,118,396 discloses a process based on molten salt electrolysis for producing pure rare earth metals. This process is the direct electrolytic deposition of a rare earth metal such as neodymium, from a molten salt cell containing a mixture of electrolytes and a salt of neodymium, onto a liquid magnesium cathode forming an intermediate alloy. The intermediate alloy is distilled to isolate the neodymium metal. Also disclosed is a process for producing a pure neodymium/iron alloy wherein pure iron is added to the intermediate neodymium/magnesium alloy during the distillation step.

U.S. Pat. Nos. 5,091,065 and 4,966,661 disclose a fused salt process for the production of neodymium and neodymium alloys. According to this fused salt electrolysis process, by collecting the formed neodymium or neodymium alloy at the bottom of the bath and incorporating oxygen gas in the atmosphere above the bath, powdery carbon generated from the carbon electrodes is removed by oxidation and consumption and the electrolysis bath is stabilized. Furthermore, by using a plate-shaped electrode at least for the anode, the critical current is increased and neodymium or a neodymium alloy can be formed at a high cathodic current density and a high current efficiency.

U.S. Pat. No. 5,000,829 discloses a process for the preparation of a praseodymium-iron alloy or a praseodymium-neodymium-iron alloy, which comprises using praseodymmium fluoride ($PrF_3$) or a mixture of praseodymium fluoride and neodymium fluoride ($NdF_3$) as the starting material and carrying out the electrolysis in a fused salt electrolyte or bath.

U.S. Pat. No. 4,828,658 discloses a process for the electrolytic preparation of a mother alloy of iron and neodymium by the reduction of a mixture comprising at least one reactive oxygen-bearing compound of neodymium in a bath of molten halides with at least one metallic cathode, preferably of iron, and a carbon anode. This patent suggests treating the offgases containing 12% tetrafluoromethane, $CF_4$, by applying liquifaction and distillation.

U.S. Pat. No. 4,747,924 discloses a process and an apparatus for producing a neodymium-iron alloy by electrolytic reduction of neodymium fluoride in a bath of molten electrolyte, consisting essentially of 35–76% by weight of neodymium fluoride, 20–60% by weight of lithium fluoride, up to 40% by weight of barium fluoride and up to 20% by weight of calcium fluoride, conducted between one or more iron cathode and one or more carbon anode.

However, in spite of these references, there is still a great need for an improved electrolytic process for producing neodymium or neodymium alloys which avoids or greatly minimizes anode effects, evolution of fluorine-containing compounds, and excessive side reactions in the cathode region.

SUMMARY OF THE INVENTION

It is an object of this invention to provide an improved electrolytic process for producing rare earth metals.

It is another object of this invention to provide an improved electrolytic process for production of neodymium or neodymium alloys.

Yet, it is another object of this invention to provide a process for the electrolytic production of neodymium or neodymium alloys without anode effect.

And yet, it is a further object of this invention to provide a process for the electrolytic production of neodymium or neodymium alloys without the emission of fluorine-containing off gases.

And yet, it is a further object of this invention to provide a process for the electrolytic production of neodymium or neodymium alloys with minimal side- or back-reaction at the cathode and at the collected metal product.

And yet, it is a further object of this invention to provide an improved electrolytic process for the production of neodymium wherein the oxide concentration in the electrolyte is maintained higher at the anode than at the cathode.

These and other objects will become apparent from the specification and claims appended hereto.

In accordance with these objects, there is provided a method for producing neodymium or neodymium alloys in an electrolytic cell, the method comprising the steps of providing an electrolyte in the electrolytic cell and providing an anode in an anode region of the electrolyte and providing a cathode in a cathode region of the electrolytic cell. An oxygen-containing neodymium compound is dissolved in the electrolyte, the dissolution aided by high bath agitation in the anode region, and a higher concentration of dissolved neodymium compound is maintained in the anode region than in the cathode region. An electrolytic current is passed between the anode and the cathode and neodymium metal is deposited at the cathode.

DETAILED DESCRIPTION OF THE PREFERRED EMBODIMENTS

Figure 1:
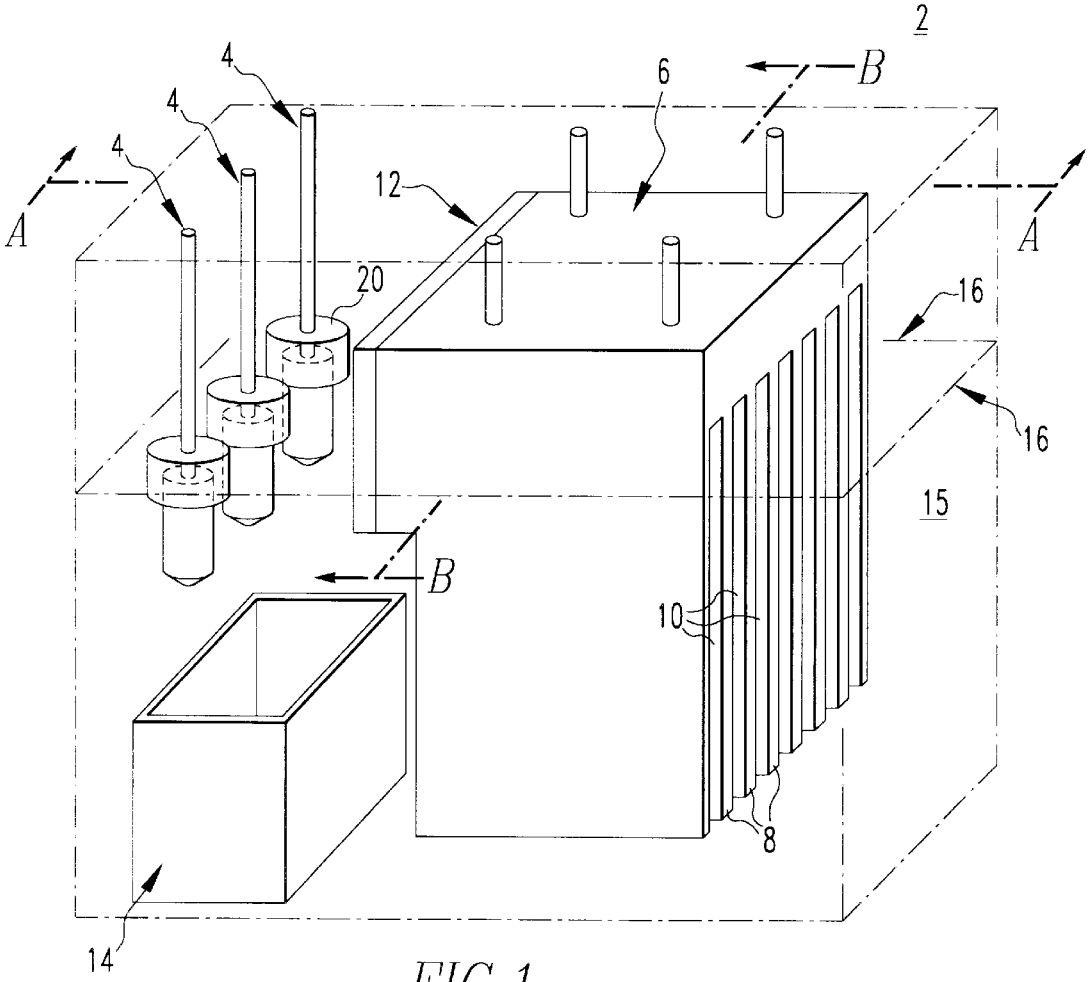
FIG. 1 is a dimensional view of an electrolytic cell for the production of neodymium.

FIG. 1 illustrates an embodiment of an electrolytic cell 2 suitable for producing neodymium in accordance with the invention. The cell contains a series of cathodes 4 and an anode 6 divided into a series of plates 8 oriented radially with respect to the cathodes and having openings 10 between plates 8. Openings 10 provide for free circulation of electrolyte therebetween. The surface area provided by the anodes is an important feature of the invention, as discussed hereinafter. Anode 6 is provided with a face or plate 12 which serves as a barrier or weir to restrict free circulation of electrolyte having oxygen-containing neodymium compounds dissolved therein. Plate 12 is provided between anode 6 and cathodes 4. Thus, electrolyte circulation induced by gas bubble formation is vigorous in the anode region and quiescent in the cathode region. Electrolyte in the anode region is enriched in dissolved neodymium oxygen-containing compounds and the electrolyte in the cathode region has a lower concentration of neodymium oxygen-containing compounds dissolved therein. This difference in oxide concentration can be enhanced by introducing a supplemental anode in the cathode region that consumes oxide. This can be an exposed part of the main anode or can be a separate anode, preferably shielded such that the anode gases rise within the shield rather than through the bulk of the catholyte.

The cell is provided with a container 14 for collecting neodymium or neodymium alloy which is formed or deposited at the cathode in liquid or molten form and thereafter drops off into container 14.

Electrolyte 15 is provided in cell 2 to the level indicated by line 16. Preferably, the electrolyte is comprised of fluoride salts, such as LiF—$NdF_3$ or $NdF_3$—$CaF_2$—LiF. The electrolyte is comprised of 20 to 80 wt. % $NdF_3$, 0 to 50 wt. % $CaF_2$ and 0 to 50 wt. % LiF, the remainder incidental elements and impurities. Preferably, the electrolyte is comprised of 50 to 60 wt. % $NdF_3$, 20 to 30 wt. % $CaF_2$ and 10 to 20 wt. % LiF with a typical electrolyte comprised of about 50 wt. % $NdF_3$, about 30 wt. % $CaF_2$ and about 20 wt. % LiF. The electrolyte may contain $BaF_2$, but this is not preferred because of the toxicity of barium compounds.

Preferably, anode 6 is comprised of carbon or graphite. Further, plate 12 can be any material that is not attacked by electrolyte. A suitable material for plate 12 is boron nitride, alumina, or metal such as iron that is electrically isolated from the anode and the cathode.

When metallic neodymium is prepared, carbon electrodes can be used for both anodes and cathodes. When a neodymium alloy, for example, neodymium/iron alloy, is desired, a carbon electrode is used for the anode and an iron electrode is used for the cathode. When metallic neodymium is preferred, only the anode is the consumable electrode, but when neodymium/iron alloy is prepared, then both electrodes are consumed.

If a metal other than iron is desired to be alloyed with the neodymium, then this other metal is used as the cathode. Also, an inert non-alloying cathode can be used to provide neodymium metal.

The feed material or source of neodymium for addition to the electrolyte is usually an oxygen-containing neodymium compound. Thus, the source of the neodymium compound to be added to the electrolyte is $Nd_2O_3$, $Nd_2(CO_3)_3$, or $Nd_2O_2CO_3$, or organic neodymium compounds.

Typically, the electrolyte in the cell is maintained at a temperature in the range of 800° to 1100° C. Also, typically the cell is operated at an anode current density in the range of 0.01 to 1.0 A/cm$^2$, a cathode current density in the range of 0.1 to 20 A/cm$^2$, and a voltage in the range of 2 to 5V.

When the anode is consumed, oxygen released on the surface of the anode is converted to oxides of carbon such as carbon monoxide and/or carbon dioxide. By the use of carbon as used herein is meant to include all types of carbon including graphite. By the use of iron as used herein is meant to include any kind of iron that can be used as a cathode, including steels such as low carbon steels.

The carbon monoxide and carbon dioxide anodic reactions are as follows:

$$C+2O^{2-}\rightarrow CO_2+4e^-$$

$$C+O^{2-}\rightarrow CO+2e^-$$

Some of the carbon dioxide and carbon monoxide reacts with the rare earth metal produced and reaction products therefrom are deposited at the cathode as an undesirable deposit. Carbon dioxide and carbon monoxide also react electrochemically at the cathode, and typically the reaction takes place at the three-phase interface formed at the solid cathode, the liquid electrolyte and gas phase. As noted earlier, this carbon-containing cathode deposit upsets the optimum conditions for operating the electrolytic cell. Further, carbon-containing deposits interfere with the efficiency of the cell because the rare earth metal, e.g., misch metal or neodymium, gets deposited on or incorporated in the carbon-containing cathode deposit which further aggravates or disrupts the operation of the cell. It should be noted that the invention has application to any electrolytic cell, such as those used for producing rare earth metals or alloys including misch metal as well as neodymium or neodymium alloys.

Figure 2:
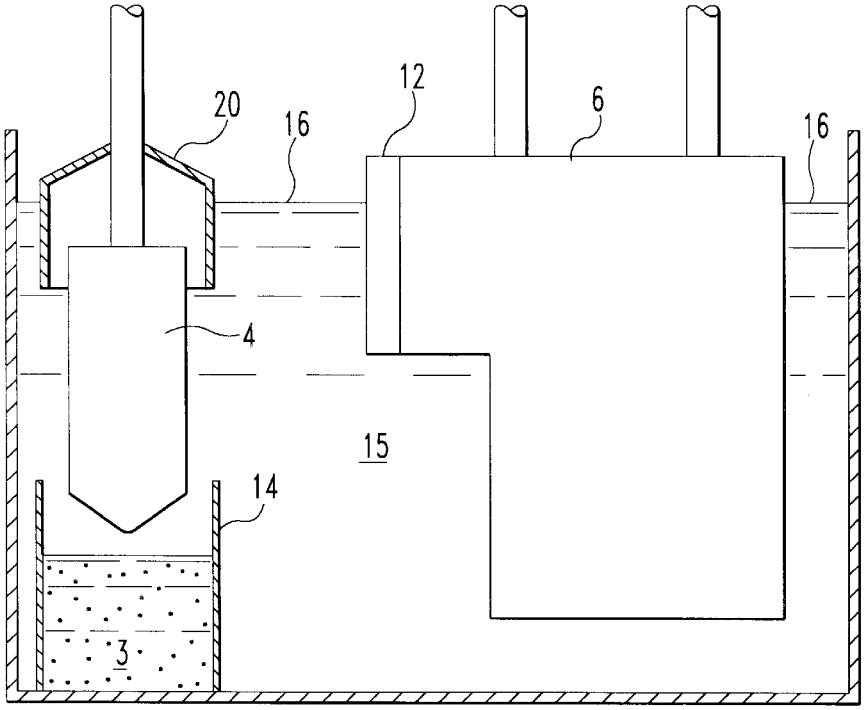
FIG. 2 is a cross-sectional view of the cell in FIG. 1 along the line A—A.
Figure 3:
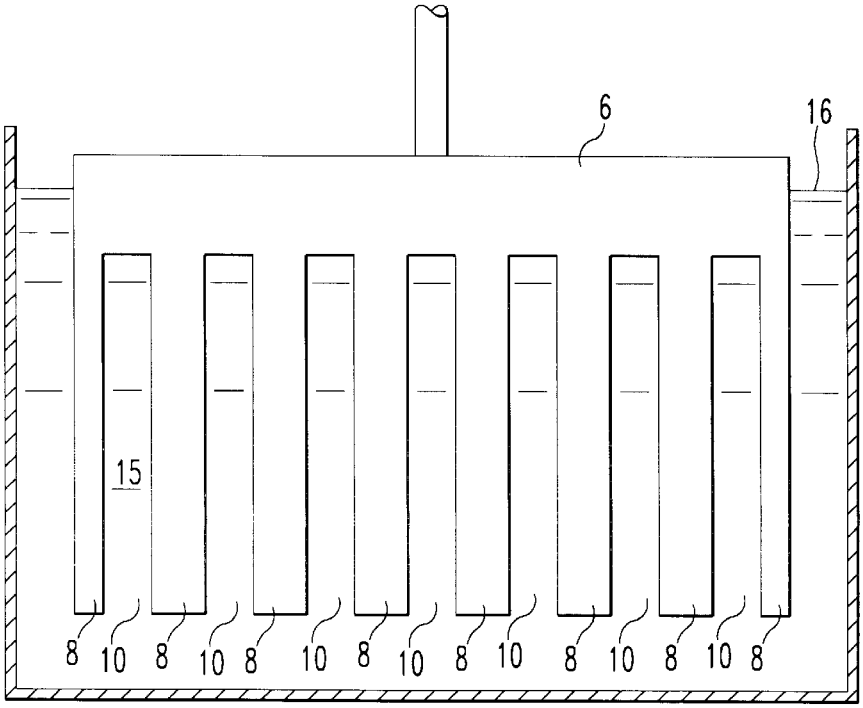
FIG. 3 is a cross-sectional view of the cell in FIG. 1 along the line B—B.

To avoid this problem, it has been discovered that deposits do not form around the cathode at the electrolyte surface if a shield is provided or positioned surrounding the cathode. Thus, a shield 20 is positioned to surround cathode 4 as shown in FIGS. 1 and 2. Shield 20 should extend into electrolyte 15 to a depth sufficient to prevent carbon monoxide or carbon dioxide from coming in contact with the cathode. However, care must be taken to avoid extending shield 20 to a point where it interferes with the production of neodymium or neodymium alloys. Shield 20 is advantageous because it permits the use of a gas in space between cathode 4 and shield 20. Gas that can be utilized in the space can be an inert gas such as argon or it may be a reactive or gettering gas used to purge the space.

Shield 20 is comprised of a non-conductive material. By non-conductive is meant that the shield material does not conduct electrical current to the point where carbonaceous products grow on the shield. Or, the shield may be constructed of a conductive material and be electrically insulated from the cathode. Thus, the shield is non-conductive with respect to the cathode. In addition, shield 20 is fabricated from a material that is inert with respect to electrolyte 15. That is, dissolution of shield 20 in electrolyte 15 should be avoided in order to guard against contaminating the electrolyte bath. Thus, shield 20 can be comprised of a material selected from the group consisting of boron nitride, aluminum oxide, aluminum nitride and silicon nitride. The shield can be formed into a single unit by ceramic processing and then fitted around the cathode.

It has been discovered that high oxide contents and electrolyte agitation lead to excessive interactions of metal product with electrolyte compounds. These can result in the formation of sludge-like products or deposits detrimentally interfering with operation of the cell.

Figure 4:
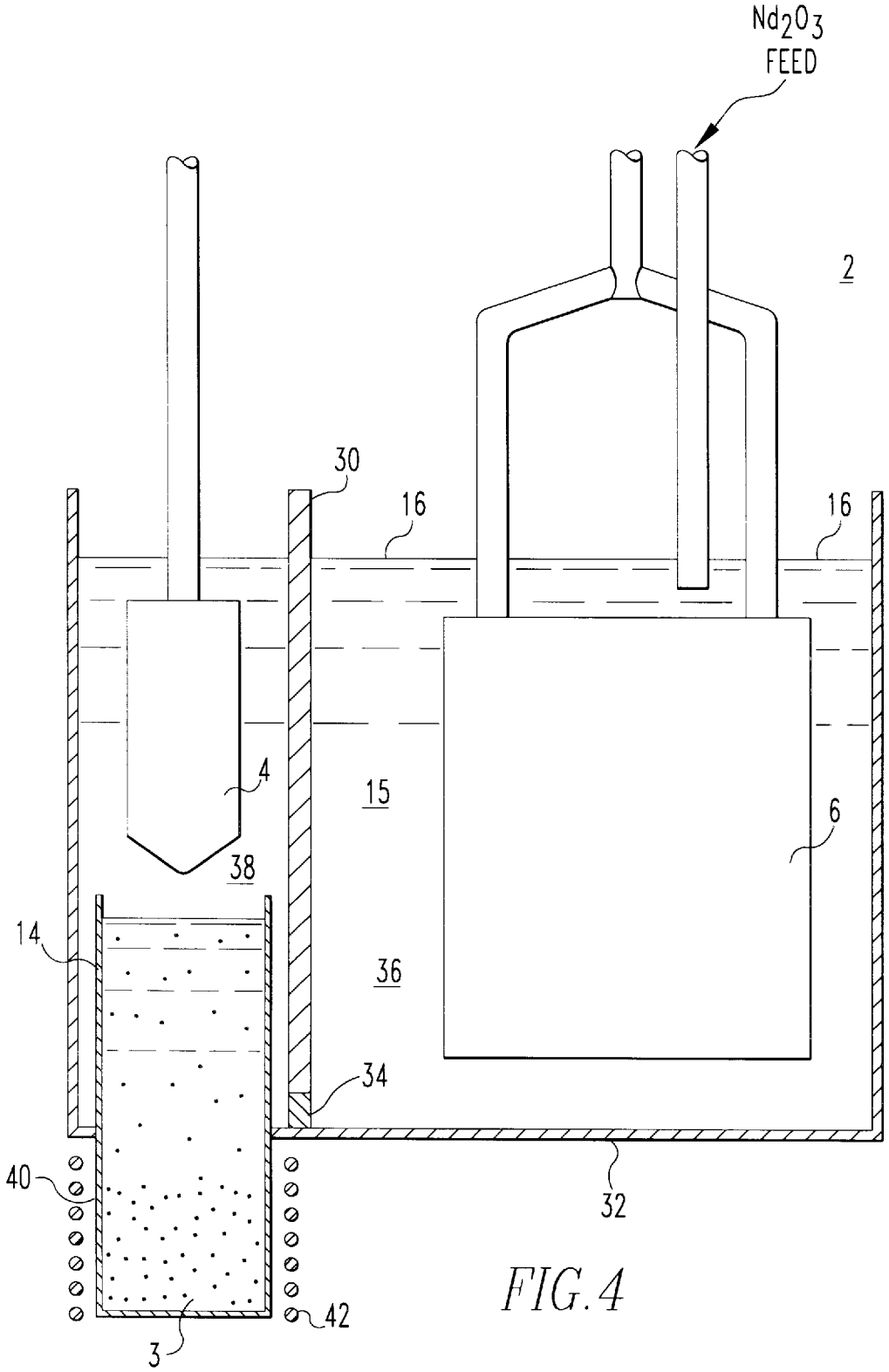
FIG. 4 is a cross-sectional view of an electrolytic cell showing the anode and cathode separated by a porous member.

Another embodiment of the invention is shown in FIG. 4. In this embodiment, a porous barrier or divider 30 is provided across electrolytic cell 2 to separate anode 6 from cathode 4. Divider 30 should extend above electrolyte level 16 and should extend to floor 32. However, a layer of a non-conductive material 34 should be provided between divider 30, floor 34 and sides (not shown) of the electrolytic cell. That is, divider 30 should be electrically insulated from the floor and sides of cell 2.

Divider 30 is characterized in that it can be fabricated from a porous material that is permeable with electrolyte 15 and neodymium ions. Also, divider 30 should be resistant to attack by electrolyte in order to avoid contamination of the bath. When an electric current is passed between the anode and cathode, the porosity of divider 30 should permit free transportation of neodymium ions to the cathode for deposition. Divider 30 can be fabricated from a ceramic material such as porous boron nitride, alumina, and/or a metallic material such as porous sintered stainless steel or a porous carbon material such as porous graphite, these conductive materials kept electrically isolated from anode and cathode. While the cathode is shown separated from the anode by dividing the cell, it will be understood that the anode or cathode can be isolated by surrounding the anode or cathode on sides and bottom with a porous barrier, and such is contemplated within the invention.

Divider 30 is important in that it permits separating the electrolytic cell into an anode region 36 and a cathode region 38. Thus, a higher concentration of dissolved $Nd_2O_3$ can be maintained in anode region 36 than in cathode region 38. Divider 30 or weir 12 is important in that it restricts circulation of the electrolyte and thus a high concentration of dissolved $Nd_2O_3$ can be maintained in the anode region. Preventing or minimizing electrolyte circulation in the cathode region, which includes the metal collection area, restricts dissolution of neodymium metal deposited at the cathode. That is, it restricts continued dissolution of neodymium metal into electrolyte wherein it can be recirculated back to the anode and re-oxidized, greatly lessening the efficiency of the cell. Further, divider 30 or weir 12 is important for another reason. That is, divider 30 or weir 12 operates to restrict flow of gases generated at the anode. Gases generated at the anode can extend to the cathode and react with the neodymium metal to form sludge, a mixture of neodymium metal and oxide, which can get mixed with the neodymium metal, greatly interfering with the productivity of the cell. And yet, divider 30 or weir 12 are important for the reason that they direct and enhance circulation of electrolyte in the anode region to enhance dissolution of neodymium oxide. Also, high concentration of dissolved neodymium oxide in the anode region permits use of high current density at the anode without forming fluorine-containing compounds such as $CF_4$.

The concentration of dissolved neodymium oxide in the electrolyte in the anode region can range from 0.05 to about 3 wt. %, preferably, the amount of dissolved neodymium oxide in the electrolyte is in the range of about 0.1 to 0.5 wt. %.

The current density at the anode can range from 0.01 to 1.0 $A/cm^2$, preferably the current density is maintained in the range of 0.01 to 0.05 $A/cm^2$.

In the present invention, the cell voltage at the anode is maintained at a level between 3.5 and 4.5 V. At these low voltages, reactions of the fluoride at the anode to form fluorine-containing gaseous compounds are substantially avoided, even at oxide contents as low as 0.05 to 0.1 wt. % (as oxygen).

By anode over voltage is meant the voltage in excess of the equilibrium deposition voltage for producing oxides of carbon.

This results in a low anode overvoltage, i.e., a low voltage in excess of the equilibrium deposition voltage for producing oxides of carbon.

In another embodiment of the invention, container 14 may be provided with a sump 40 which extends below bottom 32 of cell 2. Sump 40 is provided with electrical heating coils 42 which permit independent temperature control of metal 3 in a sump 40. This has the advantage that metal 3 can be maintained or collected in a solid condition and does not react with or get dissolved in the electrolyte. When it is desired to remove metal 3 from the cell, the solidified metal may be melted using resistance heaters 42 after liquid metal can be tapped or drained from sump 40.

While the invention has been particularly described with respect to neodymium, it should be understood that its application is not limited thereto. That is, the invention has application to any lanthanide or actenide, rare earth metal such as lanthanum, cerium, praseodymium and samarium produced in an electrolytic cell. In other words, this invention has application to metals having atomic numbers 57 through 71 and with atomic numbers 89 through 103. Also, the invention has application to misch metals which are comprised mainly of rare earth (lanthanide) components in metallic form, the largest component being usually cerium but the composition can vary, depending on the source and treatment of the oxides.

The following examples are further illustrative of the invention.

EXAMPLE 1

A neodymium-iron alloy with an average composition of 69.7% by weight neodymium and 30.3% iron by weight was prepared. An electrolyte bath containing 50 wt. % $Nd_2F_3$, 30 wt. % $CaF_2$ and 20 wt. % LiF was electrolyzed at a temperature between 1030° and 1040° C. with partially decomposed neodymium carbonate employed as feed. An inert atmosphere vessel with an iron cell lined with BN on three walls was placed in a furnace for heating. Placed at one end of the cell was a BN cup used as an alloy receiver. An anode constructed of graphite plates and a BN weir to direct the flow of electrolyte was used as shown in FIG. 1. The voltage in the cell was 4.25V. The cathode current density was 0.5 A/cm$^2$ and the anode current density was 0.03 A/cm$^2$. The current efficiency was 62.6% and feed utilization was 99.8%. A DC current of 100 A was applied for a period of 96 hours with no $CF_4$ or $C_2F_6$ observed in the off-gas. Four metal taps were completed by vacuum-siphoning the metal through an electrically preheated tapping pipe. The metal was collected as clean ingots inside the tapping vessel in an iron mold and 15.21 kg neodymium-iron alloy was obtained with an average composition of 69.7% neodymium by weight and 30.3% iron by weight.

Example 2

A neodymium-iron alloy, 14.4 kg, with an average composition of 73.6% by weight neodymium and 26.4% iron by weight was obtained by the following processes: An electrolyte bath made of three fluorides, i.e., neodymium fluoride, calcium fluoride, lithium fluoride, was electrolyzed at a temperature between 1030° and 1040° C. with neodymium oxide employed as feed. An inert atmosphere vessel with an iron cell lined with BN on three walls was placed in a furnace for heating. Placed at one end of the cell was a BN cup used as an alloy receiver. An anode constructed of graphite plates and a BN weir to direct the flow of electrolyte is shown in FIG. 1 along with the location of the three 1.25 inch diameter cathodes. A DC current of 100 A was applied for a period of 96 hours with no $CF_4$ or $C_2F_6$ observed in the off-gas. Four metal taps were completed by vacuum-siphoning the metal through an electrically preheated tapping pipe. The metal was collected as clean ingots inside the tapping vessel in an iron mold.

The current efficiency was 61.2%. 14.4 kg of neodymium-iron alloy was recovered and neodymium produced was 10.6 kg. The percent iron in the alloy was 26.4% and feed utilization was 92.9%. Again, no $CF_4$ or $C_2F_6$ was observed in the off-gas.

Thus, it will be seen that the neodymium-iron alloy can be produced without anode effects or production of undesirable fluorine-containing gases such as $CF_4$ or $C_2F_6$.

While the invention has been described in terms of preferred embodiments, the claims appended hereto are intended to encompass other embodiments which fall within the spirit of the invention.

What is claimed is:

1. A method of producing neodymium in an electrolytic cell without formation of perfluorinated carbon compounds, the method comprising the steps of:

(a) providing an electrolyte having a surface in the electrolytic cell;

(b) providing at least one anode in an anode region of the electrolytic cell and providing at least one cathode in a cathode region of the electrolytic cell;

(c) dissolving an oxygen-containing neodymium compound in the electrolyte;

(d) maintaining a higher circulation of the electrolyte in the anode region than in the cathode region; and (e) passing electrolytic current between said anode and said cathode and depositing neodymium metal at the cathode.

2. The method in accordance with claim 1 wherein said anode is provided as a series of plates having spaces therebetween for the electrolyte circulation.

3. The method in accordance with claim 1 including providing a weir between said anode and said cathode restricting circulation of the electrolyte to said cathode and maintaining high circulation of the electrolyte between said plates of said anode.

4. The method in accordance with claim 1 wherein said weir is comprised of a material selected from the group of boron nitride, alumina, or a metal without direct electric connection to both, anode and cathode.

5. The method in accordance with claim 1 including maintaining concentration of said dissolved neodymium compound in said anode region in the range of 0.05 to 3.0 wt. %.

6. The method in accordance with claim 1 including maintaining concentration of said dissolved neodymium compound in said cathode region in the range of 0.05 to 1.0 wt. %.

7. The method in accordance with claim 1 including maintaining a current density at said anode in the range of 0.01 to 1.0 A/cm$^2$.

8. The method in accordance with claim 1 including maintaining a current density at said cathode in the range of 0.1 to 20 A/cm$^2$.

9. The method in accordance with claim 1 including maintaining said cell at a voltage between 3.5 and 4.5 V.

10. The method in accordance with claim 1 including the step of maintaining at the anode an over-voltage of 2 V.

11. The method in accordance with claim 1 including the steps of maintaining current density at said anode in a range of 0.01 to 1.0 A/cm$^2$ and maintaining said neodymium compound dissolved in said electrolyte in a range of 0.1 to 0.5 wt. %.

12. The method in accordance with claim 1 including providing a cathode shield substantially inert to said electrolyte, said shield surrounding said cathode and extending above and below the surface of the electrolyte.

13. The method in accordance with claim 12 wherein said shield is substantially non-conductive with respect to said cathode.

14. The method in accordance with claim 12 wherein said shield is comprised of a material selected from the group consisting of boron nitride, aluminum oxide, aluminum nitride and silicon nitride.

15. The method in accordance with claim 1, including collecting neodymium metal product in a container that is electrically insulated from other components of the cell.

16. A method of producing neodymium in an electrolytic cell, the method comprising the steps of:

(a) providing an electrolyte in the electrolytic cell;

(b) providing at least one anode in an anode region of the electrolytic cell and providing at least one cathode in a cathode region of the electrolytic cell, said anode comprised of a series of plates of substantially parallel plates having spaces therebetween for circulating the electrolyte;

(c) providing a weir between said anode and said cathode to enhance circulation of the electrolyte in the anode region and limit circulation of the electrolyte in said cathode region;

(d) dissolving an oxygen-containing neodymium compound in the electrolyte in the anode region;

(e) maintaining a concentration of said dissolved neodymium oxygen-containing compound in the anode region in the range of 0.1 to 1.0 wt. % and in the cathode region maintaining said dissolved neodymium oxygen-containing compound at a concentration less than in said anode region;

(f) passing electrolytic current between said anode, said current density at said anode being in the range of 0.01 to 0.05 $A/cm^2$, and said cathode and depositing neodymium metal at the cathode.

17. The method in accordance with claim 16 including providing supplemental anode in the cathode region to further diminish the concentration of dissolved neodymium oxygen-containing compound.

18. The method in accordance with claim 16 wherein the weir is comprised of a material selected from the group consisting of boron nitride, alumina or a metal without direct electric contact to both anode and cathode.

19. The method in accordance with claim 16 wherein the cell is operated at a voltage sufficiently low to avoid the formation of fluorine-containing carbon compounds.

20. The method in accordance with claim 19 wherein said cell voltage is between 3.5 V and 4.5 V.

21. A method of producing neodymium in an electrolytic cell, the method comprising the steps of:

(a) providing an electrolyte in the electrolytic cell;

(b) providing an anode in an anode region of the electrolytic cell and providing a cathode in a cathode region of the electrolytic cell;

(c) separating said anode region from said cathode region using a porous wall permeable by said electrolyte and minimizing electrolyte circulation in the cathods region;

(d) dissolving an oxygen-containing neodymium compound in the electrolyte in said anode region; and (e) passing electrolytic current between said anode and said cathode and transporting neodymium ions from said anode region of said cathode region and depositing neodymium metal at the cathode.

22. The method in accordance with claim 21 wherein said porous wall is comprised of a material selected from the group consisting of boron nitride, alumina, perforated steel, and perforated stainless steel.

23. The method in accordance with claim 21 including the step of maintaining said dissolved neodymium compound in said anode region in a concentration in the range of 0.5 to 3.0 wt. %.

24. The method in accordance with claim 21 including maintaining concentration of said dissolved neodymium compound in said cathode region in the range of 0.1 to 0.5 wt. %.

25. The method in accordance with claim 21 including the steps of maintaining current density at said anode in a range of 0.01 to 0.05 $A/cm^2$ and maintaining said neodymium compound dissolved in said electrolyte in a range of 0.5 to 3.0 wt. %.

26. The method in accordance with claim 21 wherein the cell is operated at a voltage of between 3.5 and 4.5 V.

* * * * *